US007299910B2

(12) United States Patent
Smith

(10) Patent No.: US 7,299,910 B2
(45) Date of Patent: Nov. 27, 2007

(54) CLEARANCE OF COIN JAMS IN COIN VALIDATORS

(75) Inventor: Peter Ronald Smith, Aberfeldie (AU)

(73) Assignee: Microsystem Controls Pty. Ltd., Victoria (AU)

( * ) Notice: Subject to any disclaimer, the term of this patent is extended or adjusted under 35 U.S.C. 154(b) by 531 days.

(21) Appl. No.: 10/750,578

(22) Filed: Dec. 29, 2003

(65) Prior Publication Data

US 2004/0188220 A1 Sep. 30, 2004

(30) Foreign Application Priority Data

Jan. 3, 2003 (AU) ..... 2003900099

(51) Int. Cl.
*G07F 1/04* (2006.01)

(52) U.S. Cl. ..... 194/346; 194/200; 193/DIG. 1

(58) Field of Classification Search ..... 194/346; 453/63; 235/484
See application file for complete search history.

(56) References Cited

U.S. PATENT DOCUMENTS 5,647,469 A * 7/1997 Yamagishi et al. ..... 194/200
5,788,047 A 8/1998 Chung
5,915,519 A * 6/1999 Glaser ..... 194/345

FOREIGN PATENT DOCUMENTS

GB 2 375 217 A 6/2002

* cited by examiner

*Primary Examiner*—Patrick Mackey
*Assistant Examiner*—Mark J. Beauchaine
(74) *Attorney, Agent, or Firm*—Merchant & Gould P.C.

(57) ABSTRACT

A coin validator includes a coin insertion opening (40), a coin return opening (45) and a structure defining a coin path (30) from the coin insertion opening to the coin return opening. The coin path includes a return region (59) that extends upstream from the coin return opening, and means (55) to detect and identify an object in a detection region (54) of the coin path. Gate means (56) in the coin path between the detection region and the return region is responsive to identification of the object to either divert the object from the coin path or constrain it to traverse the path to the coin return opening. In one aspect, part (10) of the structure is actuable to move so as to widen substantially the whole of the coin path including the return region, whereby to facilitate clearance of jams in the coin path. In another aspect, the validator includes means (75, 65, 63), selectively releasable by a person who has inserted one or more coins into the coin insertion opening, to latch at least the actuable part of the structure in the detection region to hold substantially fixed the width of the air gap (57) in the detection region.

22 Claims, 3 Drawing Sheets

CLEARANCE OF COIN JAMS IN COIN VALIDATORS

FIELD OF THE INVENTION

This invention relates in general to the clearance of coin jams in coin validators, and is concerned in particular respective aspects with jam clearance in the detector and return regions of the coin path.

When employed herein, the term "coin" denotes both official currency coins and coin-like elements in general having a nominal value for releasing or otherwise operating prescribed equipment into which the element may be inserted. Such elements include tokens and the like.

BACKGROUND OF THE INVENTION

A common configuration of coin validator includes a coin input slot, an inclined rail extending from the input slot past one or usually a pair of detect coils, a reverse incline to a coin return or coin rejection opening, and a gate between the detect coils and the return/rejection opening that is responsive to a coin accept/reject decision to pass each coin either to the return/rejection opening or to a retention or sort region. These constructions typically have a hinged side door over the upper part of the coin path that is actuable to be pivoted open for releasing coin jams.

In a variation of the hinged jam-clearance door, cover segments over the upper and intermediate regions of the coin path are actuable to widen their coin path regions by parallel outward movement. These segments are linked to a pivotally mounted cover segment that is actuated to be hinged out and to thereby move the other cover segments and widen the associated coin path regions.

In a typical installation, the validator is hidden behind a faceplate and retained within an outer protective housing. Although the hinged door can be wholly opened by a site manager who has full access to the validator, access for the typical user inserting coins in the validator is normally restricted to activation of a push-button or the like in the faceplate, which is effective to only partially hinge open the door. Opening of the door in this way widens the coin path to a limited extent, especially nearer the hinge axis.

By such means, these configurations do allow users to clear jams in some instances, but it is a matter of practical experience in the field that the known hinged mechanisms are not capable of user-activated clearance of a significant proportion of coin jams.

In most if not all cases, the hinged door or cover segment mounts one coil of the opposed pair of detect coils and is held closed by a spring bias mechanism. The other coil is held in the main housing or chassis of the validator. This arrangement renders the validators susceptible to variation of the width of the coin path air gap between the detect coils through slackness in the spring bias mechanism or by manipulation of the door position by a user with fraudulent intent. As the response characteristics employed to distinguish coins of different denominations passing through the air gap are typically dependent on the exact width of the air gap between the detect coils, the result of a variation in the width of the air gap can be a false coin identification.

It is an object of the invention to at least address one or both of these problems.

SUMMARY OF THE INVENTION

A first aspect of the invention essentially proposes that, in order to facilitate clearance of coin jams in the coin path, part of the structure defining the coin path is actuable to move so as to widen the coin path including a region of the path that extends upstream from the coin return opening and is downstream of the gate.

The invention provides, in its first aspect, a coin validator including;

- a coin insertion opening;
- a coin return opening;
- structure defining a coin path from said coin insertion opening to said coin return opening, said coin path having a first side and a second side, said coin path further including a return region thereof that extends upstream from said coin return opening, wherein said structure includes a housing defining said first side of said coin path and a cover defining said second side of said coin path, said cover coupled to said housing at two or more mounting points;
- means to detect and identify an object in a detection region of said coin path;
- gate means in said coin path between such detection region and said return region responsive to identification of said object to either divert said object from said coin path or constrain it to traverse said coin path to said coin return opening; and
- means actuable to move said cover in a direction away from said first side of said coin path at said mounting points so as to widen substantially the whole of said coin path including said return region, whereby to facilitate clearance of jams in said coin path.

The invention therefore provides, in its second aspect a coin validator including:

- a coin insertion opening;
- a coin return opening;
- structure defining a coin path from said coin insertion opening to said coin return opening, said coin path having a first side and a second side, wherein said structure includes a housing defining said first side of said coin path and a cover defining said second side of said coin path coupled to said housing at two or more mounting points;
- means to detect and identify an object in a detection region of said coin path, which means includes a pair of spaced opposed detect elements and an air gap in said coin path between said detect elements;
- gate means in said coin path responsive to identification of said object to either divert said object from said coin path or constrain it to traverse said coin path to said coin return opening;
- wherein said cover is actuable to move said cover in a direction away from said first side of said coin path at said mounting points so as to widen at least a portion of said coin path including said air gap, whereby to facilitate clearance of jams in said coin path;
- wherein said two or more mounting points comprise two or more parallel slots and respective pins co-operatively engageable with said slots; and
- wherein said slots are formed as bent slots including first slot portions oriented to accurately define an air gap width at detection means whereby to latch said cover to hold said air gap substantially fixed.

The respective opposed detect elements may be detect coils.

Preferably said part of said structure is such that, on its movement to widen the coin path, the whole of said path opens to form a chamber in which a coin at any location in the coin path above said return region can drop to said return region. To this end, the moveable part of the structure advantageously includes a rail defining the floor of an upper part of the coin path past said detection means.

Preferably, said cover remains substantially parallel to said housing, as it moves to widen the coin path. This arrangement may be achieved by attaching the moveable part of the structure, e.g. the door, by mounting means including four parallel slots and co-operating pins.

Preferably, said movement of said cover includes a first segment of movement in said front slot portions and a second segment of movement such that said detection means is disabled for said second segment of movement.

BRIEF DESCRIPTION OF THE DRAWINGS

The invention will be further described, by way of example only, with reference to the accompanying drawings, in which.

PREFERRED EMBODIMENTS

Figure 1:
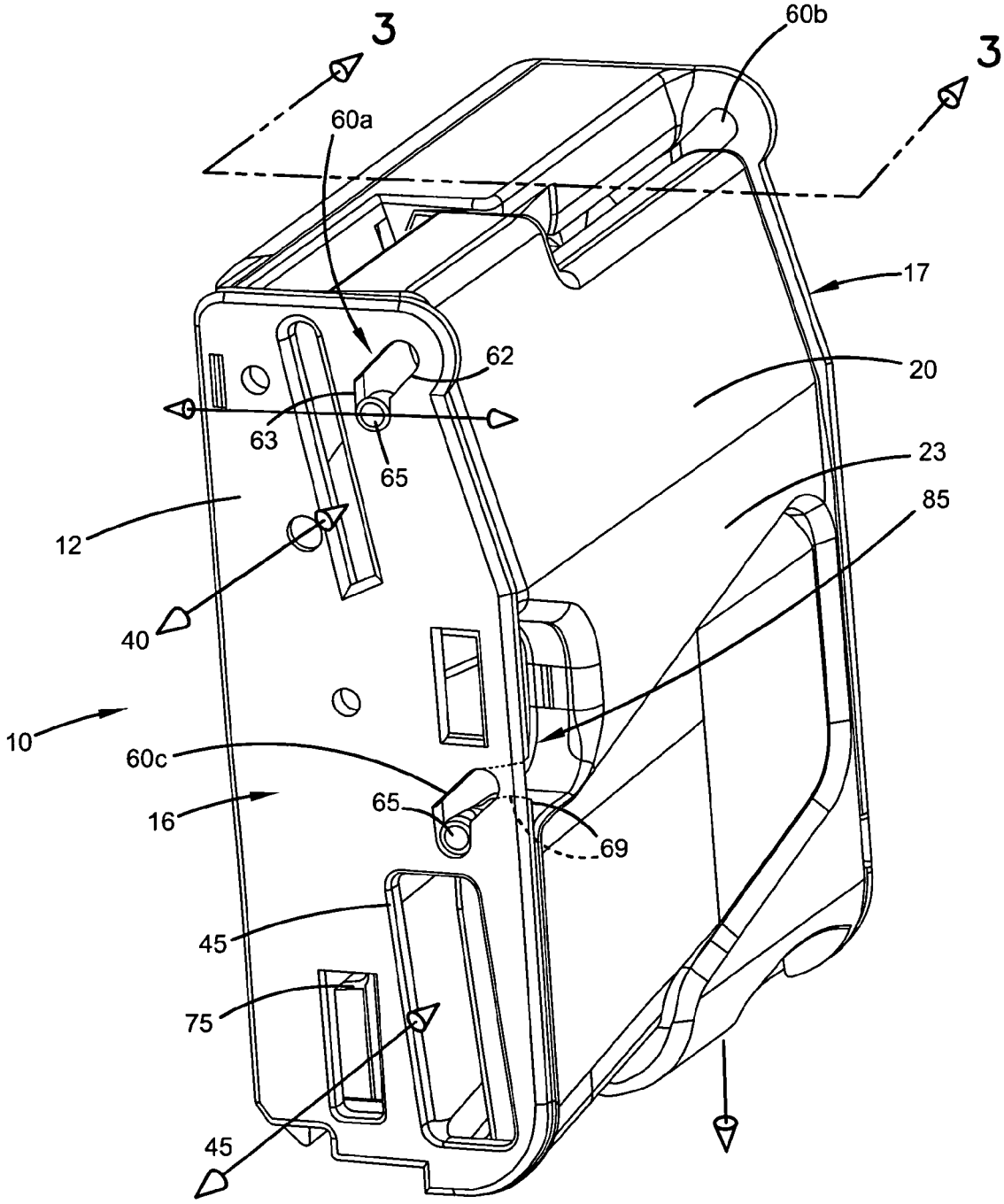
FIG. 1 is a perspective view of a coin validator according to an embodiment of the invention, incorporating both aspects of the invention.
Figure 2:
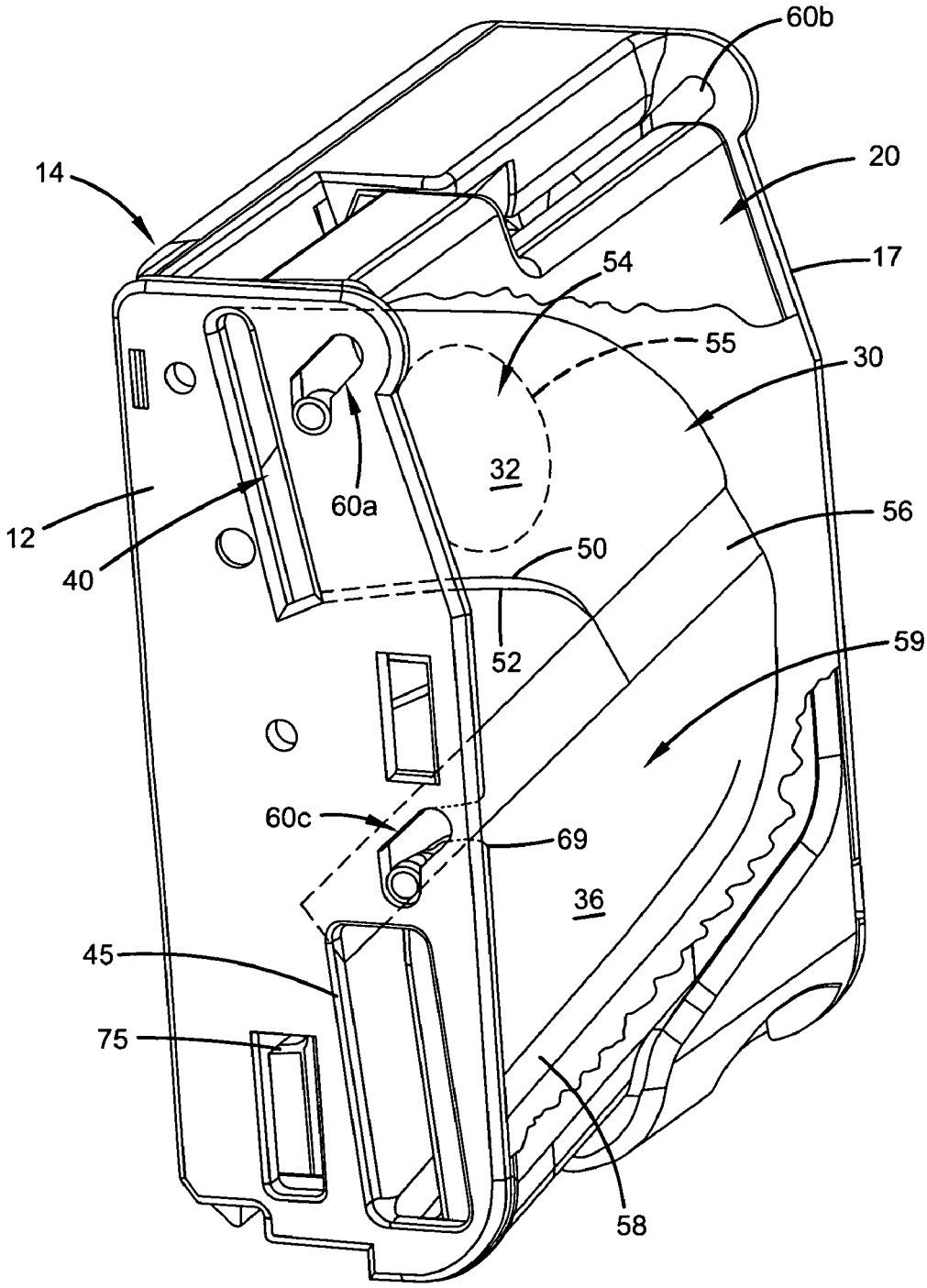
FIG. 2 is a partially cut-away view corresponding to FIG. 1.

The illustrated coin validator 10 comprises a chassis or main housing 12 and an overlying door 20. The opposed faces of housing 12 and door 20 are shaped to define a coin path 30 between these faces. Housing 12 includes end plates 16, 17 of similar external profile that embrace door 20 between them and moreover mount the door for movement in a manner to be described in due course. Coin path 30 extends from a coin insertion opening 40 in the upper part of end plate 16 to a wider coin return opening 45 in the lower part of end plate 16.

In a typical installation, the validator would be mounted behind a faceplate (not shown) that overlies end-plate 16 and has slots in register with openings 40,45. The validator would be associated with other coin-handling or coin-activated equipment that would be operable in response to the passage of a validated coin by the validator.

Coin path 30 includes an upper inclined segment 32 with a floor 50 defined by a coin rail 52 along which each coin rolls from coin insertion opening 40 through a coin detection region 54. Detection region 54 is defined by a pair of opposed detect elements, in this case coils 55, that are respectively mounted in housing 12 and door 20. Rail 52 is provided integrally on rear wall 21 of door 20, and the portion of coin path 30 between the coils comprises an air gap 57 (FIG. 3) to which further reference will be made subsequently.

Figure 3:
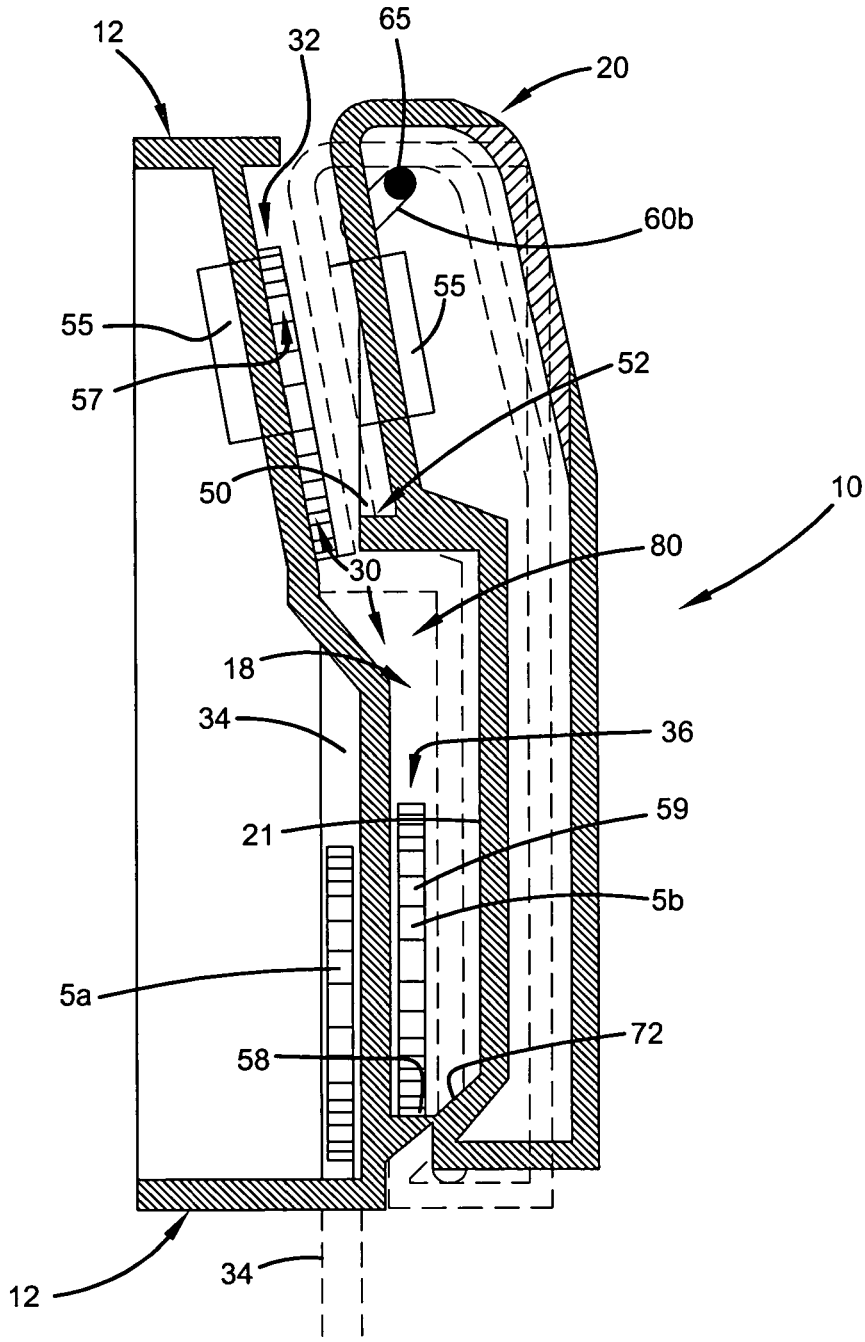
FIG. 3 is a cross-section on the line 3-3 in FIG. 1, depicting both principal conditions of the moveable jam clearance door.

At the lower end of rail 52, a gate 56, responsive to a coin accept/reject decision by controller circuitry in housing 12, either opens to allow the coin to drop into a coin accept path 34 behind wall 18 (as shown for coin 5*a* in FIG. 3), or stays closed to deflect the coin into an inclined return segment 36 of the coin path 30 (as shown for coin 5*b* in FIG. 3). This return path segment 36 includes a rail 58 integral with front wall 18 of housing 12, along which the coin rolls to coin return opening 45. Rail 58 defines a coin return region 59.

Door 20 is supported in end-plates 16, 17 by a four point pin-and-slot mounting. Two of the slots 60*a*, 60*b* are in the top front corners of each end plate 16, 17, while the other two 60*c*, 60*d* are at the mid fronts of the end-plates, just above coin return opening 45 in the case of end-plate 16. Complementary pins 65 on the end walls of door 20 snugly and slidably engage the respective slots 60.

Each slot 60 is a bent slot with two straight portions 62 (the jam clearance portion), 63 (the locking portion). Jam clearance portion 62 extends forwardly and upwardly. Locking portion 63 is aligned so as to be at or close to right angles with the air gap 57. When pin 65 is in locking portion 63, the door is latched to hold the width of the air gap 57 between detect coils 55 substantially fixed. The door is biased to this latched condition by spring loading of the release mechanism to be further discussed shortly.

If door 20 is lifted parallel to locking portions 63 of slots 60, it initially traverses a first vertical segment of movement comprising a distance predetermined by the length of slot portions 63, thereby maintaining the width of air gap 57 until the lock disengages. As the door commences movement in slot portions 63, an optical beam coin-edge detector in the detection region 54 decouples, disabling the coin detection function. Further upward movement of the door 20 causes the pins 65 to traverse a second segment of movement along slot portions 62, thereby moving the door outwardly. This upward movement of door 20 may be activated by a user by pushing a button on the faceplate (not shown) that in turn engages and pivots a lever 75 against a spring (not shown). Pivoting movement of lever 75 about an intermediate pivot mount is effective to lift the door via a pin at the inner end of the lever that engages with the door. Pivoting downwardly of the outer or free end of the lever raises the pin at the inner end and lifts the door.

In the event of a coin jam, a user may operate lever 75 fully to lift door 20 through its two step motion from the normal position shown by broken lines 20' in FIG. 3 to the full lines position 20. This movement widens the whole of coin path 30 and in particular widens the coin path 30 in coin return region 59. Moreover, because upper coin rail 52 is integral with the rear wall 21 of door 20, the movement of door 20 separates rail 52 from the front wall 18 of housing 12, and thereby opens up the coin path into a single chamber 80 in which coins in the upper inclined segment of path 30 (such as coin 5*b* in FIG. 3) can fall vertically onto lower rail 58 of the coin return region 59. These results of the door movement facilitate clearance of most jam conditions in the coin path, and delivery of the released coins through coin return opening 45.

The lower end of rear wall 21 of door 20 has an outstanding transversely inclined step 72 that complements and seats under rail 58 in the closed condition of the door but sits adjacent and flush with the outer edge of rail 58 in the raised condition (as clearly seen in FIG. 3), whereby coins are guided across onto rail 58 and thereby downwardly towards coin return opening 45.

It will be appreciated that the motion of door 20 is effective to widen the whole of the coin path including in particular the coin return region 59, and that there are no pinch points or barely widened regions arising from hinging action as in prior validators. Because of the initial segment of movement of pins 65 in portions 63 of slots 60, there is a positive latching of the width of air gap 57 between coils 55, and it is not possible for a user with fraudulent intent to lever the door to slightly vary the width of air gap 57 and thereby change the reading obtained by the validator for each coin as it passes through the air gap. In this way, the validator may misread the denomination or value of an inserted coin, to the benefit of the user.

For a site manager who has full access to the validator, door 20 may be released and fully opened, e.g. to clear a jam not released by activation of lever 75, by disengaging the lower pair of pins 65 from the upper end of their slots 60*c*, 60*d* along grooves 69, and then rotating the door upwardly about the upper pair of pins 65 still engaged in slots 60*a*, 60*b*. The door may be closed by the converse of this action.

I claim:

1. A coin validator comprising:

a coin insertion opening;

a coin return opening;

structure defining a coin path from said coin insertion opening to said coin return opening, said coin path having a first side and a second side, said coin path further including a return region thereof that extends upstream from said coin return opening, wherein said structure includes a housing defining said first side of said coin path and a cover defining said second side of said coin path, said cover coupled to said housing at two or more mounting points;

means to detect and identify an object in a detection region of said coin path;

gate means in said coin path between such detection region and said return region responsive to identification of said object to either divert said object from said coin path or constrain it to traverse said coin path to said coin return opening; and means actuable to move said cover, at said mounting points, in a direction away from said first side of said coin path so as to widen substantially the whole of said coin path including said return region, whereby to facilitate clearance of jams in said coin path.

2. A coin validator according to claim 1 wherein said cover is a door.

3. A coin validator according to claim 2, wherein said means to detect and identify an object includes a pair of detect elements respectively mounted in said housing and in said cover means.

4. A coin validator according to claim 3, wherein there are four or more of said mounting points.

5. A coin validator according to claim 1, wherein said cover is such that, on its movement to widen said coin path, the whole of said path opens to form a chamber in which a coin at any location in said coin path above said return region can drop to said return region.

6. A coin validator according to claim 5, wherein said cover includes a rail defining a floor of an upper part of said coin path past said detection means.

7. A coin validator according to claim 6, wherein there are four or more of said mounting points.

8. A coin validator according to claim 1 wherein said cover remains substantially parallel to said housing as it moves to widen said coin path.

9. A coin validator according to claim 8 wherein said two or more mounting points comprise two or more parallel slots and respective pins co-operatively engageable with said slots.

10. A coin validator according to claim 9 wherein there are four slot/pin pairs.

11. A coin validator according to claim 10, wherein said slots are formed as bent slots including first slot portions oriented to accurately define an air gap width at said detection means whereby to latch said cover to hold said air gap substantially fixed, and second slot portions in which said cover moves to widen substantially the whole of said coin path.

12. A coin validator according to claim 9, wherein said slots are formed as bent slots including first slot portions oriented to accurately define an air gap width at said detection means whereby to latch said cover to hold said air gap substantially fixed, and second slot portions in which said cover moves to widen substantially the whole of said coin path.

13. A coin validator according to claim 12 wherein movement of part of said cover includes a first segment of movement in said first slot portions and a second segment of movement in said second slot portion, and wherein means is provided such that detection means is disabled for said second segment of movement.

14. A coin validator according to claim 1, wherein said means to detect and identify an object includes a pair of detect elements respectively mounted in said housing and in said cover means.

15. A coin validator according to claim 1, wherein there are four or more of said mounting points.

16. A coin validator including:

a coin insertion opening;

a coin return opening;

structure defining a coin path from said coin insertion opening to said coin return opening, said coin path having a first side and a second side, wherein said structure includes a housing defining said first side of said coin path and a cover defining said second side of said coin path coupled to said housing at two or more mounting points;

means to detect and identify an object in a detection region of said coin path, which means includes a pair of spaced opposed detect elements and an air gap in said coin path between said detect elements;

gate means in said coin path responsive to identification of said object to either divert said object from said coin path or constrain it to traverse said coin path to said coin return opening;

wherein said cover is actuable to move said cover in a direction away from said first side of said coin path at said mounting points so as to widen at least a portion of said coin path including said air gap, whereby to facilitate clearance of jams in said coin path;

wherein said two or more mounting points comprise two or more parallel slots and respective pins co-operatively engageable with said slots; and wherein said slots are formed as bent slots including first slot portions oriented to accurately define an air gap width at detection means whereby to latch said cover to hold said air gap substantially fixed.

17. A coin validator according to claim 16 wherein said cover is a door.

18. A coin validator according to claim 16, wherein said detect elements are respectively mounted in said housing and in said cover.

19. A coin validator according to claim 16 wherein said cover includes a rail defining a floor of an upper part of said coin path past said detection means.

20. A coin validator according to claim 16 wherein said cover remains substantially parallel to said housing as it moves to widen said coin path.

21. A coin validator according to claim 16 wherein there are four slot/pin pairs.

22. A coin validator according to claim 16 wherein said movement of said cover includes a first segment of movement in said first slot portions and a second segment of movement such that said detection means is disabled for said second segment of movement.

* * * * *